US011460171B1

(12) United States Patent
Wilkerson et al.

(10) Patent No.: US 11,460,171 B1
(45) Date of Patent: Oct. 4, 2022

(54) SELECTIVELY-ADJUSTABLE BEAM ANGLE LAMP

(71) Applicant: Volt, LLC, Lutz, FL (US)

(72) Inventors: Lauren Christine Wilkerson, Wesley Chapel, FL (US); Michael Lee Caselnova, Jr., Tampa, FL (US)

(73) Assignee: Volt, LLC, Lutz, FL (US)

( * ) Notice: Subject to any disclaimer, the term of this patent is extended or adjusted under 35 U.S.C. 154(b) by 0 days.

(21) Appl. No.: 17/542,180

(22) Filed: Dec. 3, 2021

(51) Int. Cl.

| | |
|---|---|
| ***F21V 14/00*** | (2018.01) |
| ***F21V 14/04*** | (2006.01) |
| ***F21V 19/00*** | (2006.01) |
| ***F21V 14/06*** | (2006.01) |
| *F21Y 105/14* | (2016.01) |
| *F21Y 115/10* | (2016.01) |

(52) U.S. Cl.
CPC ..... *F21V 14/006* (2013.01); *F21V 14/04* (2013.01); *F21V 14/06* (2013.01); *F21V 19/0015* (2013.01); *F21Y 2105/14* (2016.08); *F21Y 2115/10* (2016.08)

(58) Field of Classification Search
CPC ..... F21Y 2105/14; F21Y 2115/10; F21V 19/0015; F21V 14/065; F21V 14/06; F21V 14/045; F21V 14/04; F21V 14/006
See application file for complete search history.

(56) References Cited

U.S. PATENT DOCUMENTS

| | | | | |
|---|---|---|---|---|
| 2014/0334161 | A1* | 11/2014 | Zhou | F21V 14/06 362/311.02 |
| 2017/0171932 | A1* | 6/2017 | Puvanakijjakorn | F21V 19/0015 |
| 2022/0003386 | A1* | 1/2022 | Yan | F21V 14/06 |
| 2022/0136667 | A1* | 5/2022 | Chen | F21V 14/06 362/362 |

* cited by examiner

*Primary Examiner* — Y M. Quach Lee
(74) *Attorney, Agent, or Firm* — Carlton Fields, PA; Eleanor M. Yost

(57) ABSTRACT

This invention relates to selectively-adjustable beam angle lamps, and in particular, selectively-adjustable beam angle LED lamps.

24 Claims, 6 Drawing Sheets

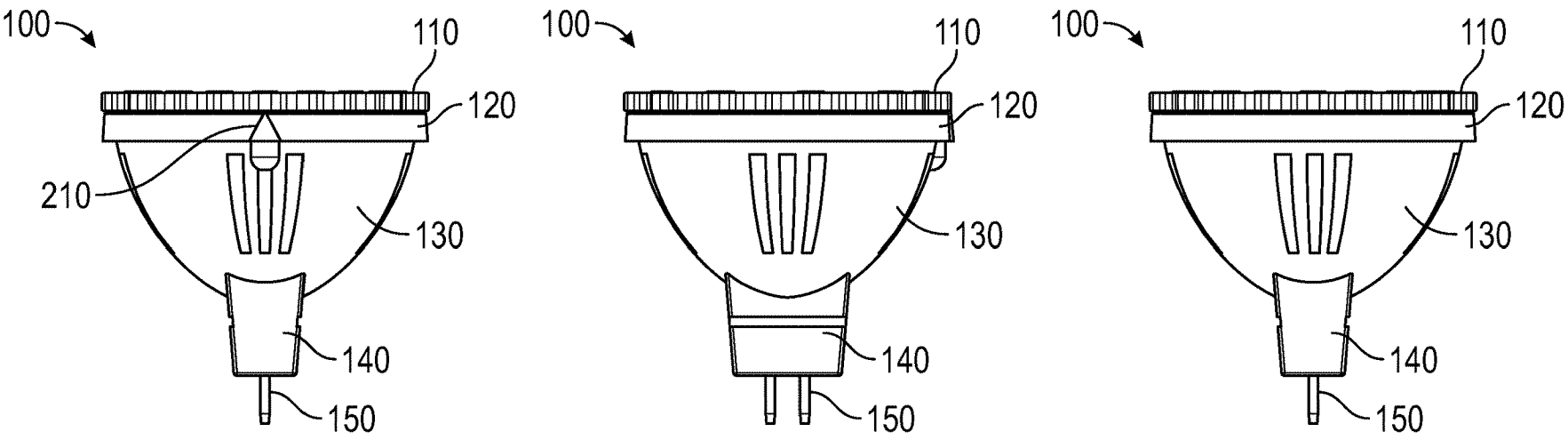
FIG. 2A
FIG. 2B
FIG. 2C
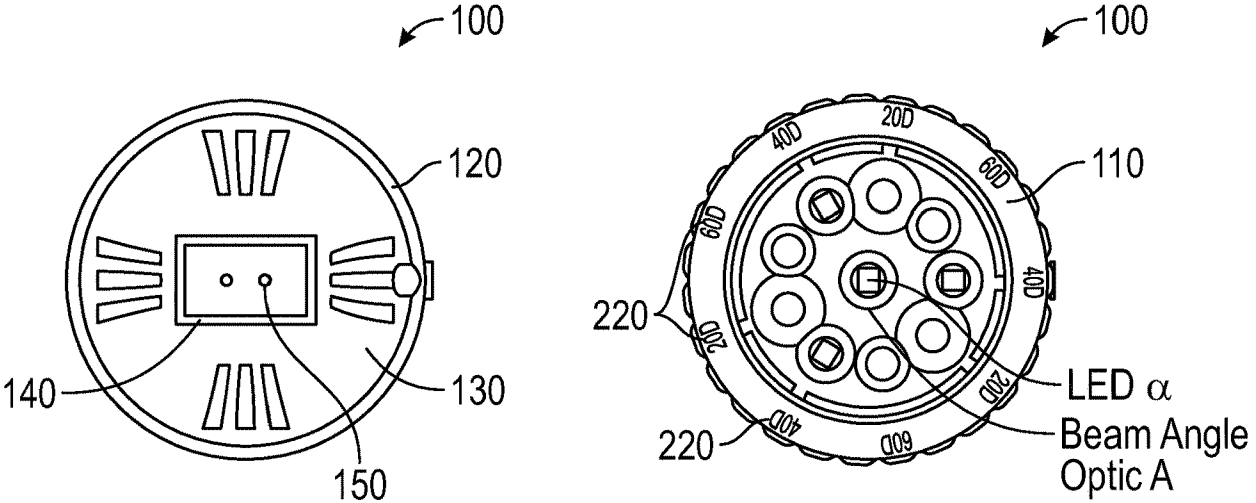
FIG. 2D
FIG. 2E

SELECTIVELY-ADJUSTABLE BEAM ANGLE LAMP

FIELD OF THE INVENTION

This invention relates to selectively-adjustable beam angle lamps.

BACKGROUND OF THE INVENTION

Lighting systems may be selectively-adjustable in terms of beam angle distribution. Light beam angle is an angular expression for how light is emitted from a light source, such as a narrow angle from 5 to 45 degrees, or wide angle from 45 to 120 degrees. Flashlights, task lights, spot lights, and other lighting systems can be arranged to emit light at different angular distributions, e.g., narrow through wide-beam—depending on the task at hand.

Flashlights typically provide a single level of control (e.g., a rotatable ring on the outside of the flashlight body) in order to control the distribution of light from a narrow circular beam to a wider circular beam. The beam angle is varied by moving the light source(s) (e.g., the LED array, bulb, or other light source) toward or away from the focal point of an optic like a lens or parabolic mirror. As the light source is moved away from the focal point, its image is blurred, forming a wider beam. The image is also degraded, which may be visually undesirable in many other applications. Furthermore, moving the lens often reduces the collection efficiency of the lens, as light that is not refracted by a lens or reflected by a reflector surface is lost.

Because of these drawbacks, most light sources use a single, fixed lens to create beams of various beam divergences. For light bulbs such as, e.g., MR-16 bulbs, several different types of optics are manufactured to (e.g., with "narrow" angle, "medium" angle, or "wide" angle flood characteristics) resulting in the conventional narrow beam angles ("spot lights") to wide angles ("flood lights"). With integrated prisms or diffuser lenses, modern LED lamps are now available with beam angles from 10 to 120 degrees. But beam angle distribution in such cases is only selectively-adjustable by removing and replacing the entire lamp (fitted with the desired fixed lens optic) with an entirely different bulb having a lens that will result in a different angular-beam divergence. The need to remove and replace entire bulbs in this manner is costly, cumbersome, and inefficient.

To address these drawbacks, external fixtures to selectively-select beam angles have been developed. For example, U.S. Pat. No. 10,208,935 to Erdener describes a LED landscape spotlight light assembly having an adjustable beam angle control dial that allows for changing the beam angle of the light output of the fixture by hand without breaking one or more water tight seals that protect some of the electronics and optics of the light fixture. The LED landscape spotlight achieves beam angle control by moving an LED bulb or lighting assembly closer or further away from a fixed-lens optic (much as would be the case in a conventional flashlight or similar fixture) using a beam angle control dial. Erdener therefore does not describe a selectively-adjustable beam angle lamp that does not require moving the light source toward or away from a fixed-lens optic in order to achieve different beam angles.

Other attempts at addressing the drawbacks of the prior art include large LED arrays paired with static secondary optics and electrical controllers.

For example, there exists a number of U.S. patents directed to lighting systems having specialized driver circuits for activating subsets of LEDs in an array that are statically paired with optics coordinated with particular beam angles, including U.S. Pat. No. 6,773,139 issued to Sommers, et al., which discloses a lighting system having a plurality light emitting diodes arranged on a substrate, where each light emitting diode is paired with a static lens element that has a selected optical prescription. The optical prescriptions disclosed in Sommers vary. In order to adjust the beam angle, a user selectively applies electrical power to only a subset of the light emitting diodes which are paired with the lenses having the optical prescription associated with the desired beam angle. The other light emitting diodes, paired with lenses having other optical prescriptions, are not activated. When a change in beam angle is desired, the user withdraws the electrical power from the first subset of light emitting diodes and applies it to another subset that is paired with lenses having the optical prescription associated with the desired beam angle. But to selectively-adjust the beam angle of the lighting system, the inventions described in Sommers require a specialized electrical control mechanism paired with individually-addressable light emitting diodes, and a very large number of light emitting diodes in the array, since each light emitting diode is paired with only a fixed-lens optic having one prescription. This is not desirable when producing small format bulbs or lamps.

Similarly, U.S. Pat. No. 10,485,066 to Catalano discloses a lamp including an array of LEDs disposed at or near the focus of a reflecting optic having multiple segments with different aiming angles (i.e., the angle corresponding to a reflected beam output direction), and a driver circuit for discretely activating subsets of the LEDs in the array associated with angles associated with particular beam angles. Like in Sommers, each light emitting diode in Catalano is associated with one beam angle, and is separately addressed with an electrical control mechanism. The array described in Catalano similarly requires a large number of LEDs to capture the potential range of desired angles. This is more expensive and inefficient to produce in small, commercial formats.

Other lighting systems in the prior art include lamps having fixed-lens optics associated with one prescription for one beam angle. Manufacturers who wish to offer several beam angle products are required to offer several different SKUs, and contractors and installers must carry them with them to jobs. This is inefficient and costly. These limitations and others are overcome by inventions described herein, which contemplate lamps having selectively-adjustable beam angles without the need for large LED arrays having individually-addressable, networked subsets associated with different beam angles, fixture-level beam angle control dials, or specialized electrical drivers.

SUMMARY OF THE INVENTION

An embodiment of the inventions described herein comprises, in one form thereof, a selectively-adjustable beam angle lamp having a rotatable beam angle selector including a plurality of primary beam angle optics, wherein each of the plurality of primary beam angle optics corresponds to (i) a prescription for a beam angle, and (ii) a stop catch, and wherein at least two of the primary beam angle optics correspond to prescriptions associated with different beam angles; a light source. The selectively-adjustable beam angle lamp further includes an indicator ring comprising an indent within which is disposed a spring-loaded stop; drive electronics; a housing having a heat sink and a cavity in which the light source and drive electronics are mounted; and a base assembly. The selectively-adjustable beam angle lamp may further include light sources, such as an LED array and/or individual LED, or an incandescent, or a compact fluorescent.

The rotatable beam angle selector may be fabricated from a polycarbonate or molded plastic material. The housing may include an aluminum, zinc, or die cast alloy material. The base assembly may include an aluminum or zinc alloy material. The housing may further have a plastic overmold.

The plurality of primary beam angle optics have prescriptions in ranges from about 10 to about 120 degrees. They may be disposed about the beam angle selector in a substantially circular or semi-circular pattern. The lamp may further include a primary beam angle optic located in the center of the beam angle selector.

The indicator ring may be either mounted on the housing or be integral therewith, and comprises an arrow positioned proximate to the indent. The lamp may further include a plurality of beam angle position indicator markings.

The spring-loaded stop may include a spring and a stopper. The stop catch may have notch in a bottom surface of the rotatable beam angle selector configured to receive a portion of the spring-loaded stop.

Another embodiment of the inventions described herein comprises, in one form thereof, a selectively-adjustable beam angle lamp having a cylindrical housing including a heat sink and a cavity in which a light source and drive electronics are mounted; a beam angle selector secured to the cylindrical housing, the beam angle selector having a plurality of primary beam angle optics, wherein each of the plurality of primary beam angle optics has a prescription corresponding to a beam angle, said beam angle selector being rotatable with respect to the cylindrical housing to select between at least two primary beam angle optics having prescriptions associated with different beam angles; an indicator ring comprising a spring-loaded stop disposed in an indent disposed on a top surface of the indicator ring; a spring configured to apply a spring-bias force to the spring-loaded stop; and wherein the spring-loaded stop is alignable with a stop catch.

Yet another embodiment of the inventions described herein comprises, in one form thereof, a selectively-adjustable beam angle lamp having a cylindrical housing having a heat sink and a cavity in which a light source and drive electronics are mounted; and a beam angle selector secured to the cylindrical housing having a plurality of primary beam angle optics each having a prescription corresponding to a beam angle, and a bottom surface, said beam angle selector being rotatable in a horizontal plane parallel to the cylindrical housing, wherein rotation of the beam angle selector dis-aligns primary beam angle optics associated with a first beam angle from the light source and aligns primary beam angle optics associated with a second beam angle with the light source, while maintaining the physical distance in a vertical plane between the bottom surface of the beam angle selector and the light source.

A further embodiment of the inventions described herein comprises, in one form thereof, a method for assembling a selectively-adjustable beam angle lamp, comprising the steps of: providing a housing comprising a sidewall surrounding a cavity and a heat sink; inserting an LED array into the cavity, the LED array comprising a plurality of LEDs; inserting a stop into a spring to form a spring-loaded stop; inserting the spring-loaded stop into an indent on a top surface of an indicator ring integrated in the housing; coupling a rotatable beam angle selector to the indicator ring using fasteners, wherein the rotatable beam angle selector comprises a plurality of integrated primary beam angle optics each having a prescription corresponding to a beam angle, and a bottom surface having indents, said rotatable beam angle selector being rotatable in a horizontal plane with respect to the top surface of the indicator ring; and rotating the rotatable beam angle selector to adjust the beam angle emitted by the selectively-adjustable beam angle lamp while maintaining the vertical distance between the bottom surface of the beam angle selector and the top surface of the indicator ring.

Another embodiment of the inventions described herein comprises, in one form thereof, a selectively-adjustable beam angle lamp, comprising a rotatable beam angle selector having at least nine primary beam angle optics, wherein a first set of at least three primary beam angle optics correspond to a prescription for a beam angle of about 20 degrees, a second set of at least three primary beam angle optics correspond to a prescription for a beam angle of about 40 degrees, and a third set of at least three primary beam angle optics correspond to a prescription for a beam angle of about 60 degrees; wherein the rotatable beam angle selector has a bottom surface comprising a plurality of stop catches, wherein each of the plurality of stop catches corresponds to each of the primary beam angle optics; an indicator ring comprising a selector arrow and an indent within which is disposed a spring-loaded stop; a housing having a light source, heat sink, and drive electronics, wherein the light source comprises an LED array, and further comprises LEDs; and wherein the rotatable beam angle selector is rotatably-fastened to said housing such that the distance between the rotatable beam angle selector and the housing remains constant during rotation.

In yet a further embodiment of the inventions described herein, a method of adjusting a beam angle of light emitted from the lamp for a lamp having a beam angle selector having a plurality of primary beam angle optics each corresponding to a prescription for a beam angle and a stop catch, a spring-loaded stop, an indicator ring, and a housing having a light source is disclosed, comprising the steps of: rotating the beam angle selector to align a first primary beam angle optic corresponding to a first prescription for a first beam angle with the light source; further rotating the beam angle selector to dis-align the first primary beam angle optic corresponding to a first prescription for a first beam angle with the light source, and then align a second primary beam angle optic corresponding to a second prescription for a second beam angle with the light source; wherein the vertical distance between the light source and the beam angle selector during the rotation of the beam angle selector from the first beam angle optic to the second beam angle optic is maintained.

BRIEF DESCRIPTION OF THE DRAWINGS

The present invention is disclosed with reference to the accompanying drawings, wherein:

FIG. 2A is a right side view of the selectively-adjustable beam angle lamp of FIG. 1, featuring a selector arrow;

FIG. 2B is a front view of the selectively-adjustable beam angle lamp of FIG. 1:

FIG. 2C is a left side view of the selectively-adjustable beam angle lamp of FIG. 1, which is the opposite of the left side view illustrated in FIG. 2A;

FIG. 2D is a bottom view of the selectively-adjustable beam angle lamp of FIG. 1;

FIG. 2E is a top view of the selectively-adjustable beam angle lamp of FIG. 1;

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
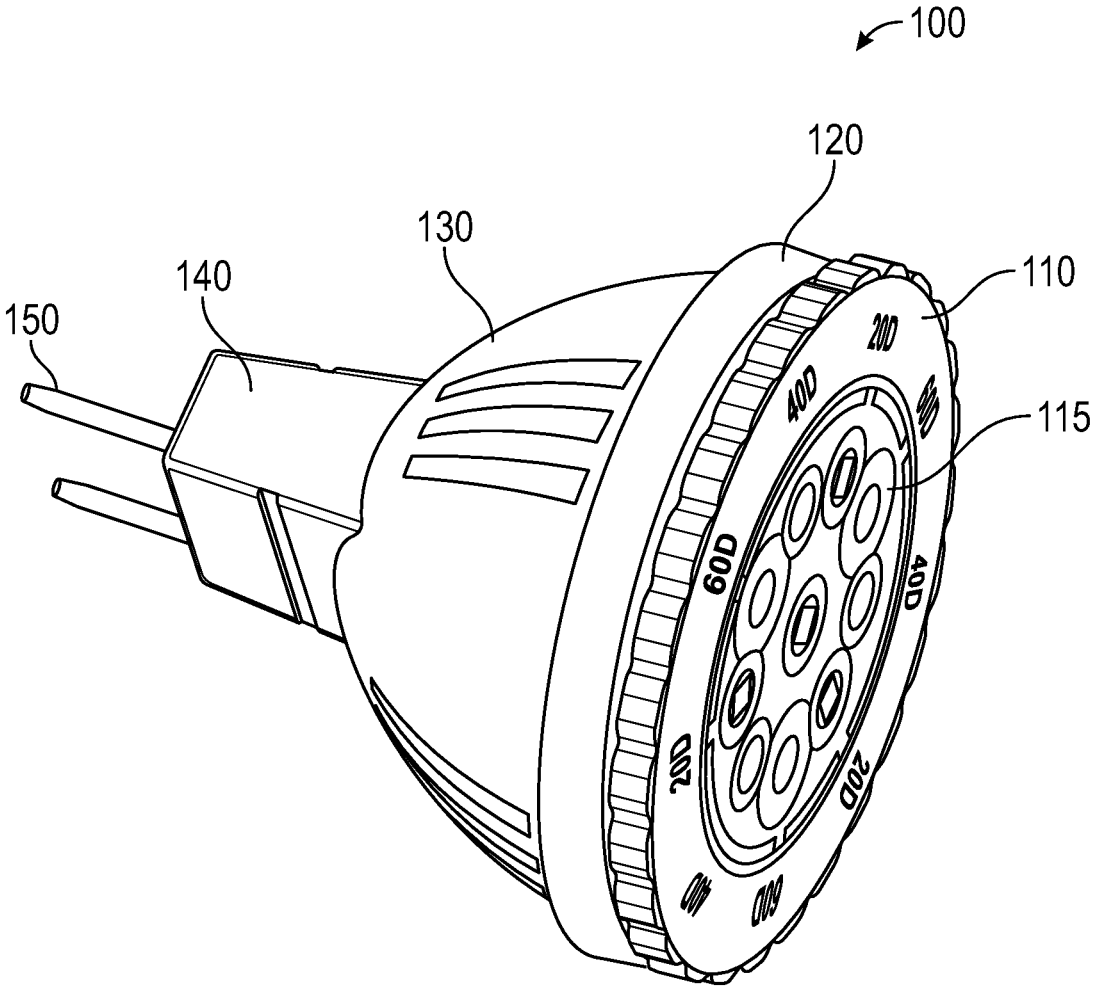
FIG. 1 is an isometric illustration of a selectively-adjustable beam angle lamp according to an embodiment of the invention.

Referring to FIGS. 1 and 2A-E, there is shown an exemplary embodiment of a selectively-adjustable beam angle lamp according to the inventions disclosed herein. In this embodiment, lamp 100 is a so-called MR-type, or multifaceted reflector bulb, and more particularly, an MR-16 type lamp. Originally introduced as halogen bulbs. MR-type lamps have recently been manufactured as energy efficient light emitting diode (LED) alternatives. The term "LED lamp" as used herein can any include any type of LED illumination source including lamp types that emit directed light where the light distribution is generally directed within a single hemisphere.

Due to its small size, the MR-type lamp is especially useful for small spaces and is the most common bulb for landscape lighting, and may also be used in lamp-ready spotlights and downlights, as well as in-grade lights, well lights and underwater lights. Lamp 100 may be other types having form factors such as PAR (including PAR-36), BR, ER, AR, and others, including alternative MR-types such as MR-8, MR-11, MR-16 and MR-20, which are also contemplated as within the scope of the inventions disclosed herein.

In this embodiment, lamp 100 includes beam angle selector 110, indicator ring 120, housing 130, base assembly 140, and bi-pins 150.

Beam angle selector 110 may be made from a UV resistant transparent material, such as molded plastics, polycarbonate, glass, or other appropriate material known to those of ordinary skill in the art. In one embodiment, beam angle selector 110 is comprised of a molded plastic. Beam angle selector 110 may be rotatably fastened to indicator ring 120 or housing 130.

Housing 130, which may be integrally formed with either or both indicator ring 120 and base assembly 140, includes a heat sink, and as shown in IG. 3, houses light source 310 and drive electronics 370. In the example shown, housing 130 is cylindrical in shape. Other shapes are contemplated.

Figure 3:
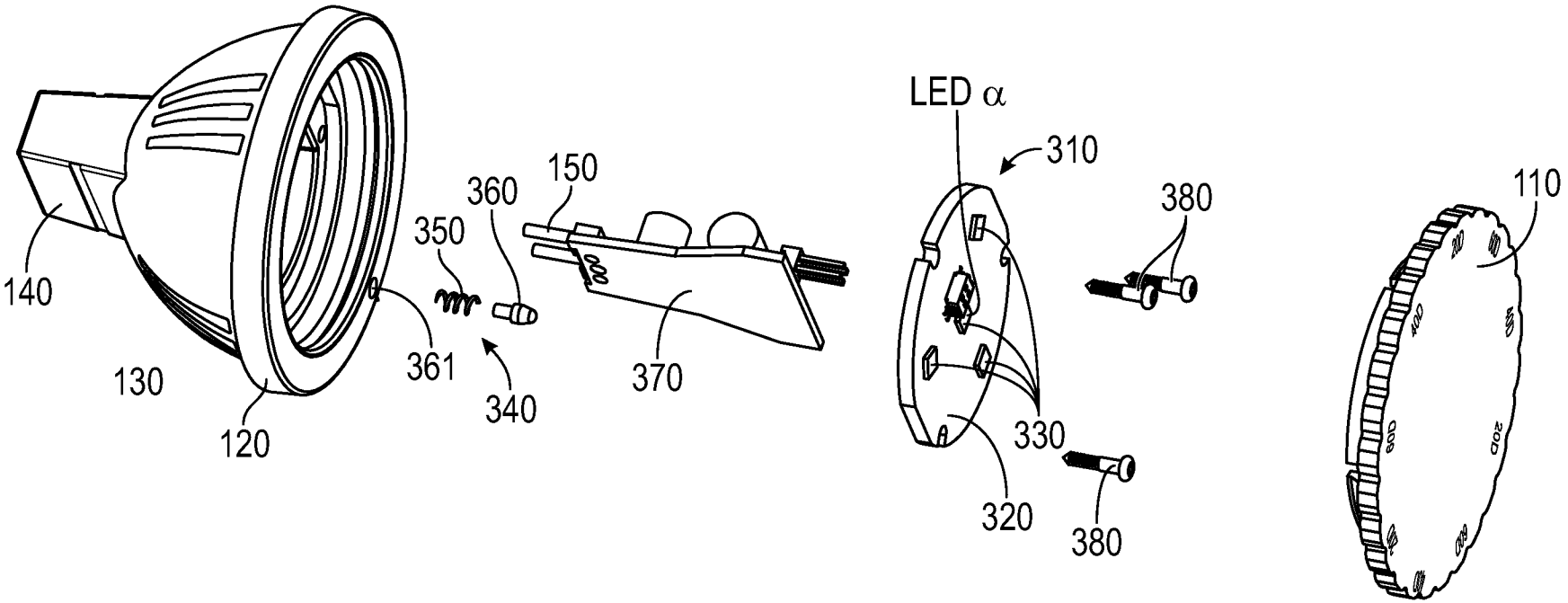
FIG. 3 is an exploded isometric view of the selectively-adjustable beam angle lamp of FIG. 1.

As shown in FIG. 3, light source 310 comprises LED array 320. LED array 320 further comprises LEDs 330. In alternative embodiments, lamp 100 may include alternative light sources 310 such as halogen, compact fluorescent, or others known to one of ordinary skill in the art. A cavity within housing 130 contains drive electronics 370 that are high temperature resistant electronic circuitry used to drive light source 310. Light source 310 and drive electronics 370 are secured within housing 130 via screws 380 or via some other fastening technique or material as known in the art. In certain embodiments, housing 130 may be formed from a material having a low thermal resistance/high thermal conductivity. In some embodiments, housing 130 may be formed from an aluminum alloy, zinc alloy, or die cast alloy or other materials known to one of ordinary skill in the art. In other embodiments, coatings may also be added to increase thermal emissivity. In one embodiment, housing 130 is fabricated from an aluminum alloy and overmolded in plastic. Base assembly 140, in conjunction with bi-pins 150, provides a standard physical and electronic interface to a light socket. Base assembly 140 may likewise be formed from an aluminum alloy or a zinc alloy, and/or may be formed from an alloy coating or overmold plastic material similar to that used for housing 130. In one example, an alloy such as AL 1100 may be used. In other embodiments, plastic material may be used as an overmold.

Figure 5:
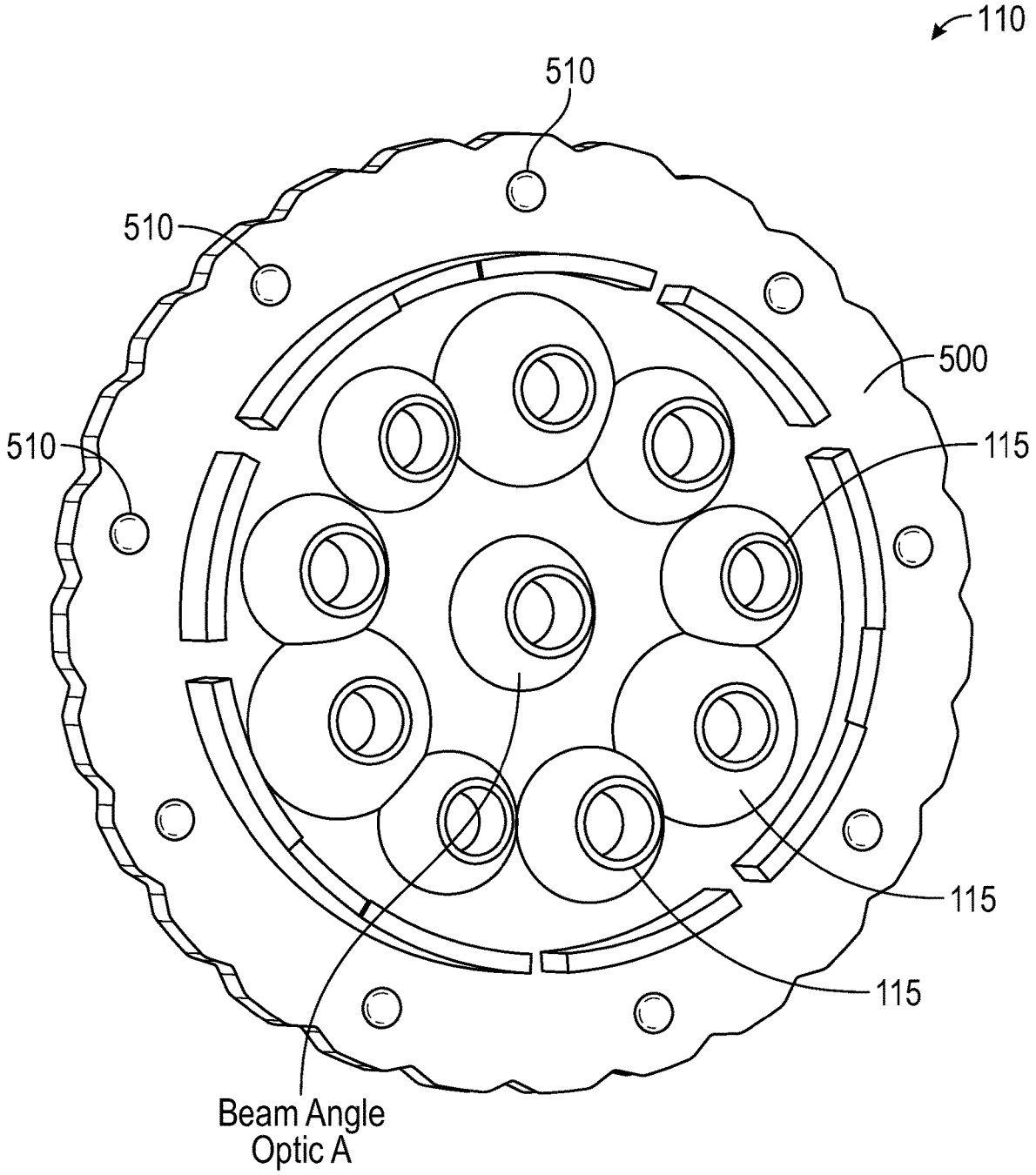
FIG. 5 is a bottom-side view of a beam angle selector.
Figure 6A:
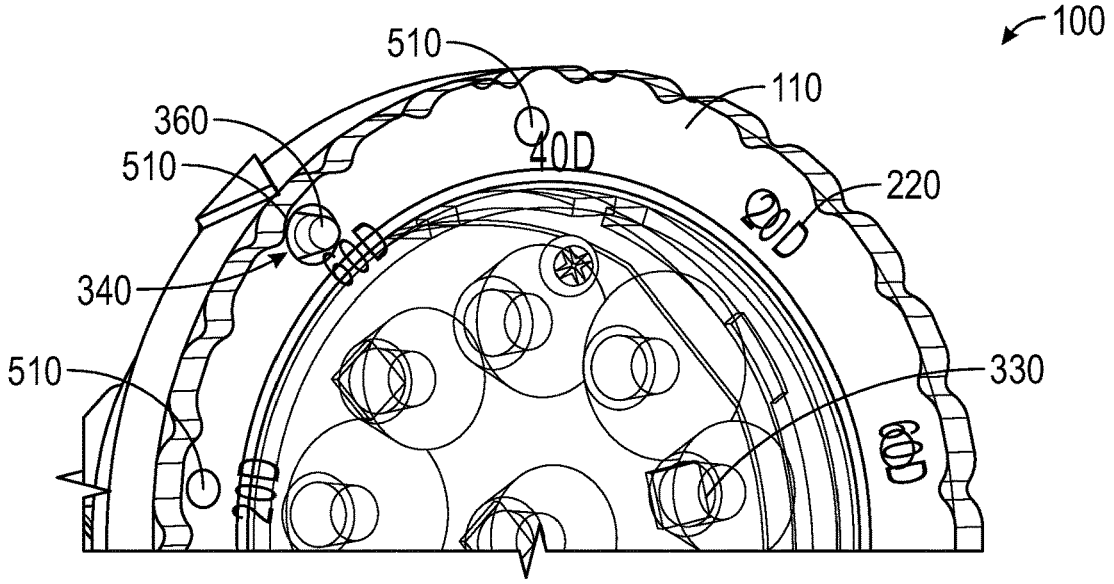
FIG. 6A is detail view of the beam angle selector and spring-loaded stop of the selectively-adjustable beam angle lamp of FIG. 1, showing a selection of a 60 degree beam angle.
Figure 6B:
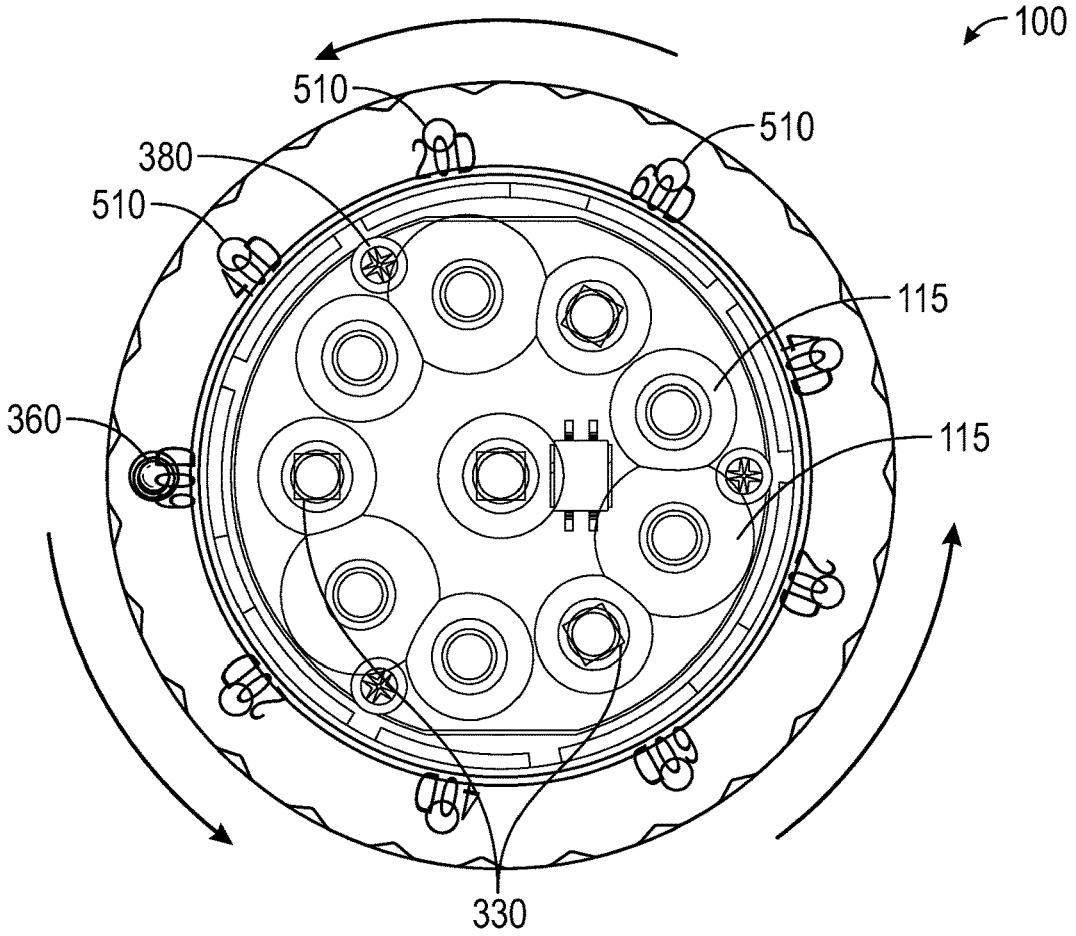
FIG. 6B is top view of the selectively-adjustable beam angle lamp of FIG. 1 featuring the beam angle selector and the spring-loaded stop and illustrating adjustment of the beam angle selector by rotating the beam angle selector counterclockwise as illustrated by the arrows.

In the embodiment shown in FIGS. 1 and 2E, beam angle selector 110 comprises a plurality of primary beam angle optics 115 (also shown in FIGS. 5, 6A and 6B). Primary beam angle optics 115 have differing prescriptions corresponding to at least two selectable beam angles. In the example shown, three primary beam angle optics 115 corresponding to a 40 degree beam angle are shown positioned over three corresponding LEDs (illustrated as squares, set in an array). Three primary beam angle optics 115 corresponding to a 20 degree beam angle and three primary beam angle optics 115 corresponding to a 60 degree beam angle are also shown. In other embodiments, prescriptions may vary anywhere from about 10 to about 120 degrees, depending on the intended usage, such as (i) narrow, about 8-15 degrees, (ii) spotlight, about 16-22 degrees, (iii) narrow floodlight about 23-32; (iv) floodlight, about 33-45 degrees; (v) wide floodlight, about 46-59 degrees, and (vi) very wide floodlight, greater than 60 degrees. In yet other embodiments, prescriptions may be referred to in words rather than degrees, such as "narrow" or "flood" or the like, and correspond to appropriate beam angles as would be readily known to one of ordinary skill in the art. In yet further embodiments, more than two beam angle prescriptions may be used.

In the embodiment illustrated in FIGS. 1-3, primary beam angle optics 115 are disposed in a substantially circular pattern about beam angle selector 110 except for, in this example, a primary beam angle optic disposed over LED $\alpha$, which is substantially centrally-positioned within LED array 320 (as also shown in FIG. 2E). In this example, four LEDs 330 on LED array 320 and ten primary beam angle optics 115 are disposed on beam angle selector 110 are illustrated. More or fewer LEDs are contemplated. At least two or more selectable beam angles are also contemplated. Other patterns are contemplated.

A user may selectively-adjust the beam angle of light emitted by the lamp by manually or mechanically rotating beam angle selector 110 clockwise or counterclockwise such that desired primary beam angle optics 115 corresponding to a particular beam angle prescription are positioned above the light source, such as light source 310 as shown in FIG. 3 (in this example, the LEDs). To facilitate rotation or improve grip, beam angle selector 110 may have scalloped edges (as shown) or other edge formations.

As shown in FIG. 2E, beam angle optic A is disposed substantially in the center of beam angle selector 110, and is located above the center LED α of LEDs 330. Beam angle optic A in this example is a lens associated with a beam angle prescription of 40 degrees, but other prescriptions may be used. Because this beam angle optic A is disposed substantially in the center of beam angle selector 110, its position relative to LED α does not change (other than rotationally) in the vertical plane (the direction perpendicular to the light-emitting surface of the LEDs) as beam angle selector 110 is dialed to select alternate beam angles. The other three LEDs 330 in this example are shown are associated with nine primary beam angle optics 115: three having beam angles of 20 degrees (indicated by the notation "20D"), three having beam angles of 40 degrees (indicated by the notation "40D"), and three having beam angles 60 degrees (indicated by the notation "60D"). Each of the LEDs 330 are covered by one of the primary beam angle optics 115, and the position of the primary beam angle optics 115 is such that the LEDs are covered by the primary beam angle optics 115 having the same prescription at the same time. As the beam angle selector 110 is rotated about indicator ring 120, all of the primary beam angle optics 115 are rotated together, so that each of the LEDs 330 are covered by next selected primary beam angle optic 115, and each will again each have the same corresponding prescription and associated beam angle. The position of the beam angle selector 110 (and thus primary beam angle optics 115) does not change in the vertical plane (the direction perpendicular to the light-emitting surface of the LEDs) as beam angle selector 110 is dialed to selectively-adjust the beam angle. In other words, the physical distance between beam angle selector 110 and light source 310 does not increase or decrease, as in conventional light fixtures like flashlights, in order to change the beam angle emitted from the lamp.

In one embodiment, primary beam angle optics 115 are primary optics. Primary beam angle optics 115 are integrated into beam angle selector 110 such that light from the light source (such as LED array 320, in one embodiment) is emitted from light source 310 and travels through primary beam angle optics 115 before being emitted from lamp 100 at the selected beam angle, without the need to pass through secondary or additional optics or lenses in order to modify the beam angle. As discussed above, beam angle selector 110 comprises a plurality of primary beam angle optics 115 of which at least two have different prescriptions corresponding to different beam angles.

Indicator ring 120 includes arrow 210 (shown in FIG. 2A). Indicator ring 120 may be integral with or be separable from housing 130. Arrow 210 may be shaped as an arrow, pointer, or any other shape that is appropriate for an indicator. As shown in FIG. 2E, beam angle selector 110 may include beam angle indicator markings corresponding to different beam angle optic positions (e.g., "20D," "40D," "60D," etc.). Alignment of arrow 210 on indicator ring 120 with a chosen beam angle position indicator marking 220 on beam angle selector 110 indicates the beam angle setting at a given point in time, as the corresponding primary beam angle optics 115 (and relative prescription) will be positioned over light source 310. Beam angle position indicator markings 220 may be in the form of specific angle degrees (e.g. "20D" or "20°"), words (e.g., "narrow," "wide," "flood" etc.), lines or markings, or some other indicator.

Figure 4:
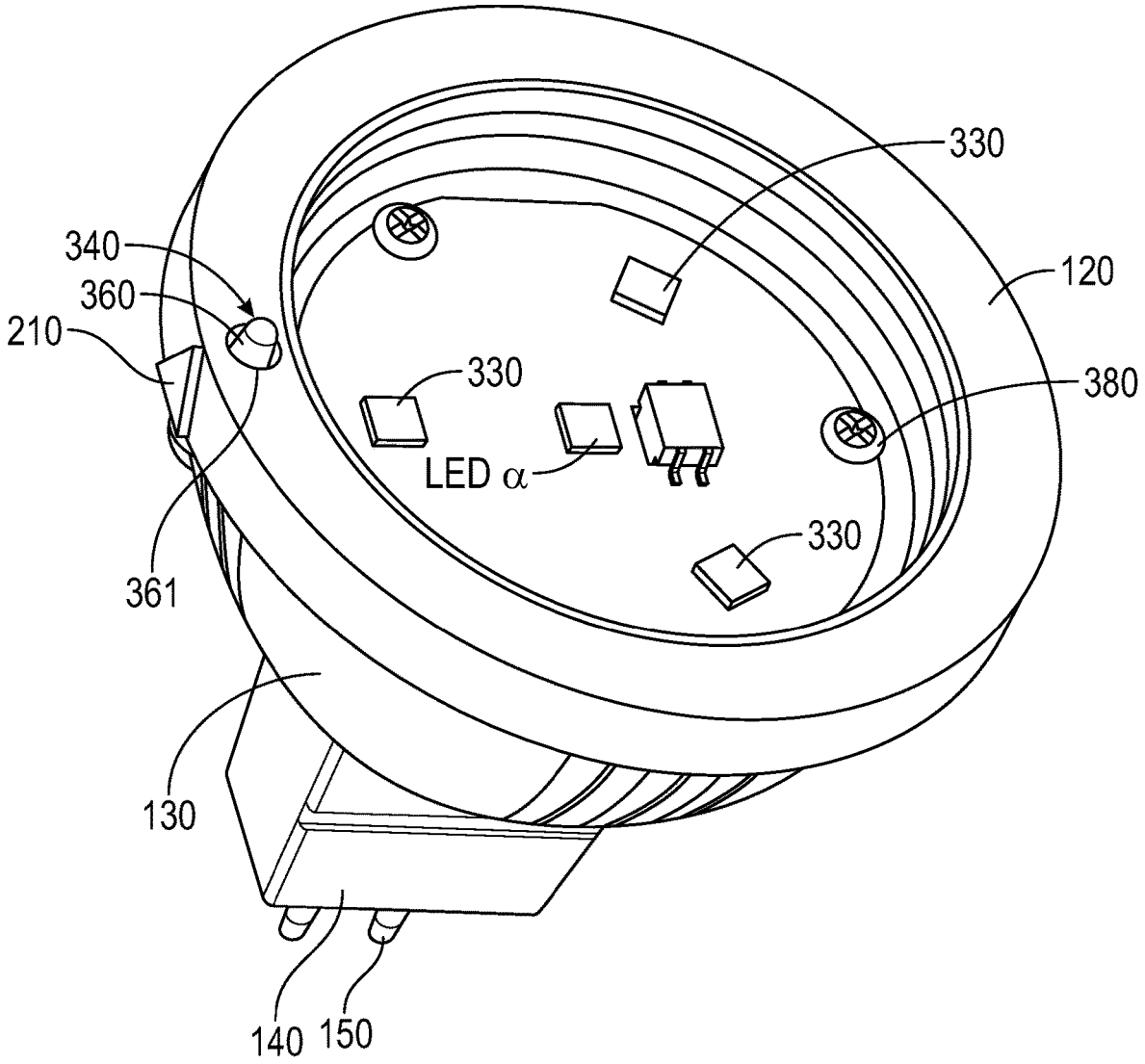
FIG. 4 is an isometric view of the selectively-adjustable beam angle lamp of FIG. 1 with the beam angle selector removed to illustrate the spring-loaded stop.

FIG. 4 illustrates the top surface of lamp 100 including indicator ring 120 without beam angle selector 110 for ease of viewing. Spring-loaded stop 340 is comprised of spring 350 and stopper 360, which are fitted together and disposed, spring first, within an indent 361 in the top surface of indicator ring 120, as shown in FIG. 4. Arrow 210 is positioned near or proximate to indent 361. As shown in this example, when spring-loaded stop 340 is disposed within indent 361 in the top surface of indicator ring 120, the uppermost portion of stopper 360 is biased by spring 350 to remain above the top surface of indicator ring 120, unless forced downward partially into indent 361 by the bottom-surface of beam angle selector 110, shown in FIG. 5.

Turning to FIG. 5, the bottom surface 500 of beam angle selector 110 is shown, illustrating a plurality of primary beam angle optics 115 (from the perspective of the reverse or underside closest to the light source) and several stop catches 510. Stop catches 510 are indentations or other notches in bottom surface 50M corresponding to each different beam angle optic position (e.g., 20D, 40D, 60D, etc.). Stop catches 510 also correspond to the position of spring-loaded stop 340 when beam angle selector 110 is assembled with housing 130. Alignment of arrow 210 on indicator ring 120 with a chosen beam angle position indicator marking 220 on beam angle selector 110 indicates the beam angle setting. As the beam angle selector 110 is rotated to that setting, the spring-bias force acting on stopper 360 is overcome, and spring-loaded stop 340 is pushed down (by bottom surface 500 of beam angle selector 110) into indent 361 in the top surface of indicator ring 120. (As shown in the embodiment illustrated in FIGS. 1 and 2A-2E, there is not enough space between the top surface of indicator ring 120 and the bottom surface 500 of beam angle selector 110 for the spring of spring-loaded stop 340 to remain fully-extended at all times the beam angle selector 110 is rotating.) When the rotation of beam angle selector 110 reaches a stop catch 510, as illustrated in FIGS. 6A and 6B, the spring-bias force acting on stopper 360 pushes stopper 360 partially up into stop catch 510. In some embodiments, the movement of spring-loaded stop 340 into stop catch 510 creates an audible noise like a "click," and may result in a momentary feeling of resistance that indicates to the user that the spring-loaded stop 340 has reached the corresponding beam angle and thus the associated primary beam angle optics 115 are positioned over light source 310. A new beam angle is selected by repeating the process, by rotating beam angle selector 110 (in this example, counterclockwise as illustrated in FIG. 6B) to overcome the spring-bias force acting on spring-loaded stop 340 and permit the rotation of beam angle selector 110 until the stop catch 510 associated with a new selected beam angle reaches arrow 210 and spring-loaded stop 340. When stopper 360 enters stop catch 510, the primary beam angle optics 115 are positioned over light source 310 and the newly-selected beam angle has been successfully selected.

It should be particularly noted that the embodiments of the inventions described herein including lamp 100 may be employed in a wide variety of applications, including but not limited to landscape lighting, a desk lamp, a reading light, a lamp for a retail display, an undercounter light, a flashlight, a ceiling light, a floor light, a wall light, an accent light, an ambient light, a recessed down light, an uplight, a retractable arm lamp, a marker light, an automobile interior light, a truck interior light, a motorcycle light, an aircraft interior cabin light, a helicopter cabin light, a blimp cabin light, a boat cabin light, a boat bridge light, a submarine light, a train cabin interior light, a bus interior reading light, a rocket interior reading light, a shuttle interior reading light, a seat light for a transportation vehicle, passenger area lighting for a transportation vehicle, outdoor lighting for a transportation vehicle, a recreational vehicle light, a snowmobile light, a jet ski light, an ATV light, a dashboard light, a backlight for a gauge, a display light, a headlight for a vehicle, a tail light for a vehicle, a signal light for a vehicle, a ground effects light for a vehicle, an aisle light, a work light for a toolbench, a workshop light, a hardhat lamp, a diver's lamp, a bicycle lamp, a camping lamp, a portable lamp, a table lamp, a standing floor lamp, a backlight, a TV light, a stereo light, a bookcase light, a spotlight, an indoor spotlight, a display case light, an outdoor spot light, a stairway light, an aquarium light, a light on an electrical device, a closet light, a food warming lamp, a music stand lamp, a mixer board lamp, a hot tub lamp, a signal lamp, a shower light, a bathroom light, an outdoor light, a ceiling fan light, a chandelier light, a tanning bed, a safety light, an emergency light, a stage light, a special effects light, a strobe light, an exterior light, an interior light, a post mounted light, a street light, a medical light, an optical light, a dental light, a light for disinfecting, a microscope lamp, an x-ray box bulb, an operating room light, a surgical light, a hospital light, a library light, a school light, a photography light, a flash bulb, a holiday light, a simulated fire, a pool light, a marine lighting and warning system, a highway light, a park light, a pathway light, a walkway light, a parking lot light, a dock light, a sign light, a billboard light, a transit shelter light, a siren, a lightbar, an underwater light, a neon-style sign, a garden light, or others.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs. It also should be appreciated that LEDs may be configured to generate radiation having various bandwidths for a given spectrum (e.g., narrow bandwidth, broad bandwidth).

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (employing one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication and/or illumination. An "illumination source" is a light source that is particularly configured to generate radiation having a sufficient intensity to effectively illuminate an interior or exterior space.

The term "lighting fixture" refers to an apparatus having mounting arrangements for the light source(s), enclosure/housing arrangements and shapes, and/or electrical and mechanical connection configurations. Additionally, a given lighting fixture may optionally may be associated with (e.g., include, be coupled to and/or packaged together with) various other components (e.g., control circuitry) relating to the operation of the light source(s).

The term "controller" is used to describe an apparatus relating to the operation of one or more light sources. A controller can be implemented in numerous ways, such as with dedicated hardware, using one or more microprocessors that are programmed using software (e.g., microcode) to perform the various functions discussed herein, or as a combination of dedicated hardware to perform some functions and programmed microprocessors and associated circuitry to perform other functions.

The term "addressable" is used herein to refer to a device (e.g., a light source in general, a lighting fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

We claim:

1. A selectively-adjustable beam angle lamp, comprising:

a rotatable beam angle selector having a plurality of primary beam angle optics wherein each of the plurality of primary beam angle optics has a prescription for a beam angle and a corresponding stop catch, and wherein at least two of the primary beam angle optics have prescriptions associated with different beam angles;

a light source;

an indicator ring comprising an indent within which is disposed a spring-loaded stop;

drive electronics;

a housing having a heat sink and a cavity in which the light source and drive electronics are mounted; and a base assembly.

2. The selectively-adjustable beam angle lamp of claim 1, wherein the light source further comprises an LED array.

3. The selectively-adjustable beam angle lamp of claim 2, wherein the LED array further comprises LEDs.

4. The selectively-adjustable beam angle lamp of claim 1, wherein the light source further comprises an incandescent.

5. The selectively-adjustable beam angle lamp of claim 1, wherein the light source further comprises a compact fluorescent.

6. The selectively-adjustable beam angle lamp of claim 1, wherein the rotatable beam angle selector is fabricated from a polycarbonate.

7. The selectively-adjustable beam angle lamp of claim 1, wherein the rotatable beam angle selector is fabricated from a molded plastic material.

8. The selectively-adjustable beam angle lamp of claim 1, wherein the housing further comprises an aluminum, zinc, or die cast alloy.

9. The selectively-adjustable beam angle lamp of claim 1, wherein the base assembly further comprises an aluminum or zinc alloy.

10. The selectively-adjustable beam angle lamp of claim 1, wherein the housing further comprises a plastic overmold.

11. The selectively-adjustable beam angle lamp of claim 1, wherein the prescriptions range from about 10 to about 120 degrees.

12. The selectively-adjustable beam angle lamp of claim 1, wherein the plurality of primary beam angle optics are disposed on beam angle selector in a substantially circular or semi-circular pattern.

13. The selectively-adjustable beam angle lamp of claim 12, further comprising a primary beam angle optic in the center of the beam angle selector.

14. The selectively-adjustable beam angle lamp of claim 1, wherein the indicator ring is mounted on the housing and further comprises an arrow positioned proximate to the indent.

15. The selectively-adjustable beam angle lamp of claim 1, wherein the indicator ring is integral with the housing and further comprises an arrow positioned proximate to the indent.

16. The selectively-adjustable beam angle lamp of claim 1, further comprising a plurality of beam angle position indicator markings.

17. The selectively-adjustable beam angle lamp of claim 1, wherein the spring-loaded stop further comprises a spring and a stopper.

18. The selectively-adjustable beam angle lamp of claim 1, wherein the stop catch comprises notch in a bottom surface of the rotatable beam angle selector.

19. The selectively-adjustable beam angle lamp of claim 1, wherein the stop catch further comprises a stop catch notch operable to receive a portion of the spring-loaded stop.

20. A selectively-adjustable beam angle lamp, comprising:

a cylindrical housing having a heat sink and a cavity in which a light source and drive electronics are mounted;

a beam angle selector secured to the cylindrical housing, the beam angle selector having a plurality of primary beam angle optics having a prescription corresponding to a beam angle, said beam angle selector being rotatable with respect to the cylindrical housing to select between at least two primary beam angle optics having prescriptions corresponding to different beam angles;

an indicator ring comprising a spring-loaded stop disposed in an indent disposed on a top surface of the indicator ring;

a spring operable to apply a spring-bias force to the spring-loaded stop; and wherein the spring-loaded stop is alignable with a stop catch.

21. A selectively-adjustable beam angle lamp, comprising:

a cylindrical housing having a heat sink and a cavity in which a light source and drive electronics are mounted; and a beam angle selector secured to the cylindrical housing having a plurality of primary beam angle optics, and a bottom surface, where each of the primary beam angle optics has a prescription that corresponds to a beam angle, and further where each beam angle corresponds to a stop catch disposed on the bottom surface, said beam angle selector being rotatable in a horizontal plane parallel to the cylindrical housing, wherein rotation of the beam angle selector dis-aligns primary beam angle optics associated with a first beam angle from the light source, and aligns primary beam angle optics associated with a second beam angle with the light source and engages a spring-loaded stop with a stop catch corresponding to the second beam angle, while maintaining physical distance in a vertical plane between the bottom surface of the beam angle selector and the light source.

22. A method for assembling a selectively-adjustable beam angle lamp, comprising the steps of:

providing a housing comprising a sidewall surrounding a cavity and a heat sink;

inserting an LED array into the cavity, the LED array comprising a plurality of LEDs;

inserting a stop into a spring to form a spring-loaded stop;

inserting the spring-loaded stop into an indent on a top surface of an indicator ring integrated in the housing;

coupling a rotatable beam angle selector to the indicator ring using fasteners, wherein the rotatable beam angle selector comprises a plurality of integrated primary beam angle optics each having a prescription corresponding to a beam angle, and a bottom surface having indents, said rotatable beam angle selector being rotatable in a horizontal plane with respect to the top surface of the indicator ring; and rotating the rotatable beam angle selector to adjust the beam angle emitted by the selectively-adjustable beam angle lamp while maintaining vertical distance between the bottom surface of the beam angle selector and the top surface of the indicator ring.

23. A selectively-adjustable beam angle lamp, comprising:

a rotatable beam angle selector having at least nine primary beam angle optics, wherein a first set comprising at least three primary beam angle optics correspond to a prescription for a beam angle of about 20 degrees, a second set comprising at least three primary beam angle optics correspond to a prescription for a beam angle of about 40 degrees, and a third set comprising at least three primary beam angle optics correspond to a prescription for a beam angle of about 60 degrees;

wherein the rotatable beam angle selector has a bottom surface comprising a plurality of stop catches, wherein each of the plurality of stop catches corresponds to each of the primary beam angle optics;

an indicator ring comprising a selector arrow and an indent within which is disposed a spring-loaded stop;

a housing having a light source, heat sink, and drive electronics, wherein the light source comprises an LED array, and further comprises LEDs; and wherein the rotatable beam angle selector is rotatably-fastened to said housing such that physical distance between the rotatable beam angle selector and the housing remains constant during rotation.

24. In a lamp having a beam angle selector having a plurality of primary beam angle optics each corresponding to a prescription for a beam angle and a stop catch, a spring-loaded stop, an indicator ring, and a housing having a light source, a method of adjusting a beam angle of light emitted from the lamp, comprising the steps of:

rotating the beam angle selector to align a first primary beam angle optic corresponding to a first prescription for a first beam angle with the light source;

further rotating the beam angle selector to dis-align the first primary beam angle optic corresponding to a first prescription for a first beam angle with the light source, and then align a second primary beam angle optic corresponding to a second prescription for a second beam angle with the light source, and engage a spring-loaded stop with a stop catch corresponding to said second prescription for a second beam angle with the light source;

wherein vertical distance between the light source and the beam angle selector during the rotation of the beam angle selector from the first beam angle optic to the second beam angle optic is maintained.

* * * * *